United States Patent [19]

Casier et al.

[11] Patent Number: 4,638,943

[45] Date of Patent: Jan. 27, 1987

[54] METHOD OF HEATING ANY BUILDING OR ROOM AND APPARATUS FOR CARRYING OUT THE SAID METHOD

[75] Inventors: Yves Casier, Ermont; Philippe Cassagne, Paris; Bernard Dore; Sylvain Gicquel, both of Saint Denis, all of France

[73] Assignee: Gaz de France, France

[21] Appl. No.: 756,455

[22] Filed: Jul. 18, 1985

[30] Foreign Application Priority Data

Jul. 25, 1984 [FR] France ..... 84 11818

[51] Int. Cl.[4] ..... F24H 3/06

[52] U.S. Cl. ..... 237/7; 237/16; 126/101

[58] Field of Search ..... 237/8 R, 19, 16, 55, 237/7; 126/101; 165/DIG. 2, DIG. 12

[56] References Cited

U.S. PATENT DOCUMENTS 2,529,977 11/1950 Thomas .
2,573,364 10/1951 Scharff .
2,677,243 5/1954 Telkes ..... 237/1 R X
3,033,192 5/1962 Bogren .
4,210,102 7/1980 Dosmann ..... 126/101 X
4,369,918 1/1983 David et al. ..... 126/101 X
4,429,830 2/1984 Forster et al. ..... 237/19

FOREIGN PATENT DOCUMENTS 2347175 3/1974 Fed. Rep. of Germany .

*Primary Examiner*—Henry Bennett
*Attorney, Agent, or Firm*—Steinberg & Raskin

[57] ABSTRACT

The present invention relates to a method and an apparatus for heating a building, room or any like space characterized in that it combines into a unit a hot-water generator constituted by a fan associated with a water-air exchanger with high thermal inertia, a tank for hot water for sanitary purposes and a hot-water generator connected by a feed line and a return line to an exchanger and to a circuit for reheating the hot water stored in the tank.

3 Claims, 2 Drawing Figures

METHOD OF HEATING ANY BUILDING OR ROOM AND APPARATUS FOR CARRYING OUT THE SAID METHOD

BACKGROUND OF THE INVENTION

The present invention has essentially for a subject matter a method of heating buildings, rooms or like spaces by blowing hot air into the said building or room.

It is also directed to a heating apparatus for carrying out the said method.

It has already been proposed to provide hot air generators with on-off control of the blown air flow, but no hot air generator has hitherto been proposed in which the temperature of the air blown is modulated according to needs.

Furthermore, it has not yet been proposed to combine into a single unit means for efficiently producing hot air and hot water for the sanitary fittings, each such production being controllable separately.

SUMMARY OF THE INVENTION

The present invention has for an object to fill the abovementioned gaps by providing a heating method and a heating apparatus ensuring in particular a marked improvement in comfort and also allowing a substantial economy in energy consumption compared to the hitherto known systems.

To this end, the invention has for a subject matter a method of heating buildings, rooms or like spaces by hot air blowing, characterized in that the air to be blown is heated by being passed at a constant flow rate through a hot-water exchanger with high thermal inertia, and the said exchanger is fed from a hot-water generator equipped with at least one burner operating in on-off mode and controlled by the temperature of the air inside the building or the room to be heated, so that the on-off operation of the burner results in a modulating effect of the output temperature of the hot air being blown due to the thermal inertia of the hot-water system.

According to still another feature of the method of the invention, the said hot-water generator feeds a system for reheating water for the sanitary fittings in priority to the system for feeding the said exchanger ensuring the heating of the air to be blown.

Furthermore, the invention provides for an interruption of the blowing of hot air when its temperature falls below a critical, too-low temperature.

The invention is also directed to an apparatus for heating buildings, rooms or like spaces, characterized by the combination into a unit apparatus of a hot air generator constituted by at least one fan associated with at least one water-air exchanger with high thermal inertia, a sanitary hot-water tank and a hot-water generator connected to the water-air exchanger, as well as a system for reheating the sanitary hot-water stored in the said tank.

The apparatus of the invention is also characterized in that the hot-water generator, the storage tank and the hot air generator are arranged in the apparatus in three heat -insulated tiers.

According to still another feature of the invention, the hot-water generator constituting the lower tier of the apparatus includes a burner and an exchanger of heat between the water and the combustion products of the burner, which exchanger is connected by feed and return lines to the aforesaid water-air exchanger constituting the upper tier of the apparatus, whereas the system for heating the sanitary hot-water running through the tank constituting the middle tier communicates with the said feed and return lines.

Furthermore, the feed line is provided with a circulator or accelerator pump upstream of an electrovalve by which the said line can be connected either to the said heating system or to the said water-air exchanger.

The outlet of the hot-air generator is provided with an airstat coupled to the fan, whereas the said storage tank is equipped with an aquastat connected in particular to the burner.

According to another form of embodiment, the water-air exchanger of the hot-air generator is associated with a buffer reservoir communicating, on the one hand, with the inlet of the said exchanger and, on the other hand, with the aforesaid hot-water feed line.

There is also provided in the hot-water generator section constituting the lower tier of the apparatus a discharge outlet for the products of combustion and for the condensates.

BRIEF DESCRIPTION OF THE DRAWINGS

Other features and advantages of the invention will appear more clearly as the following detailed description proceeds with reference to the appended drawings given solely by way of example and wherein.

DESCRIPTION OF THE PREFERRED EMBODIMENTS

Figure 1:
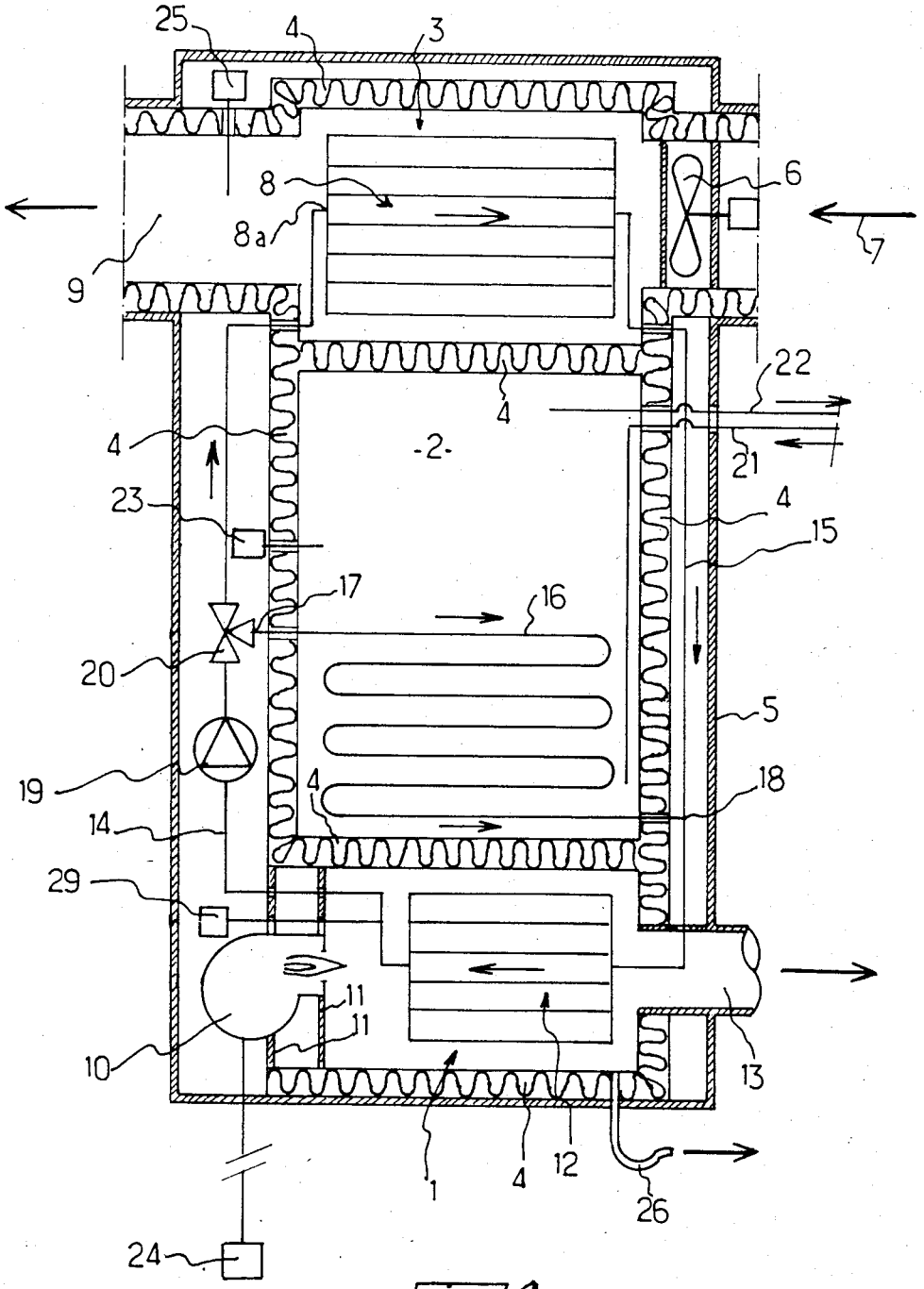
FIG. 1 is a diagrammatic elevational and vertical sectional view of a heating apparatus according to the principle of the invention.

As seen in the example of embodiment illustrated in FIG. 1, a heating apparatus according to the present invention combines into a single unit apparatus and in tiered arrangement a hot-water generator 1 constituting the lower tier of the apparatus, a tank 2 for the hot water for the sanitary fittings, constituting the middle tier, and a hot-air generator 3 constituting the upper tier of the apparatus, all of the three tiers being heat-insulated as shown at 4 and being enclosed in a box-shaped casing 5.

The hot-water generator 3 is constituted by a fan 6 blowing the air taken at 7 into the room to be heated through a hot-water exchanger 8 with high thermal inertia and a capacity of for example 30 liters of water. The heated air is blown into the room through the outlet 9 located for example at the side of the casing 5.

The hot-water generator 1 constituting the lower tier of the apparatus includes essentially a burner 10, e.g. of the forced-air type, said burner being secured to the transverse walls 11 and so directed that the products of combustion pass through an exchanger 12 for heat exchange between the water and the products of combustion. The capacity of the exchanger 12 may be for example 30 liters of water.

The exchanger 12 is connected to the exchanger 8 through a hot-water feed line 14 and through a return line 15.

At 16 is shown a heating circuit which, in the example of embodiment considered, consists of a pipe coil communicating at 17 with the feed line 14 and at 18 with the return line 15. More precisely, the feed line 14 is provided with a circulator of accelerator pump 19 upstream of an electrovalve 20 by which the line 14 can be connected either to the heating coil 16 or to the water-blown air exchanger 8.

At 21 is shown a cold-water intake conduit leading to the storage tank 2 whose capacity may range for example from 80 to 100 liters of water. At 22 is shown an outlet conduit for the hot water to the sanitary fittings.

An aquastat 23 whose function will be explained later in connection with its operation is mounted on the tank 2. A thermostat 24 located preferably in the room under the most unfavourable conditions from the thermal point of view controls the burner 10 in the on-off mode. An airstat 25 is mounted in the region of the outlet 9 for the hot air blown into the rooms. Lastly, there is shown at 26 a discharge line for the condensates resulting from the possible condensation following the evaporation of the return water in the heating loop constituted by the line 15, the exchanger 12, the line 14 and the water-air exchanger 8, in case the latter has a sufficient exchange area.

Figure 2:
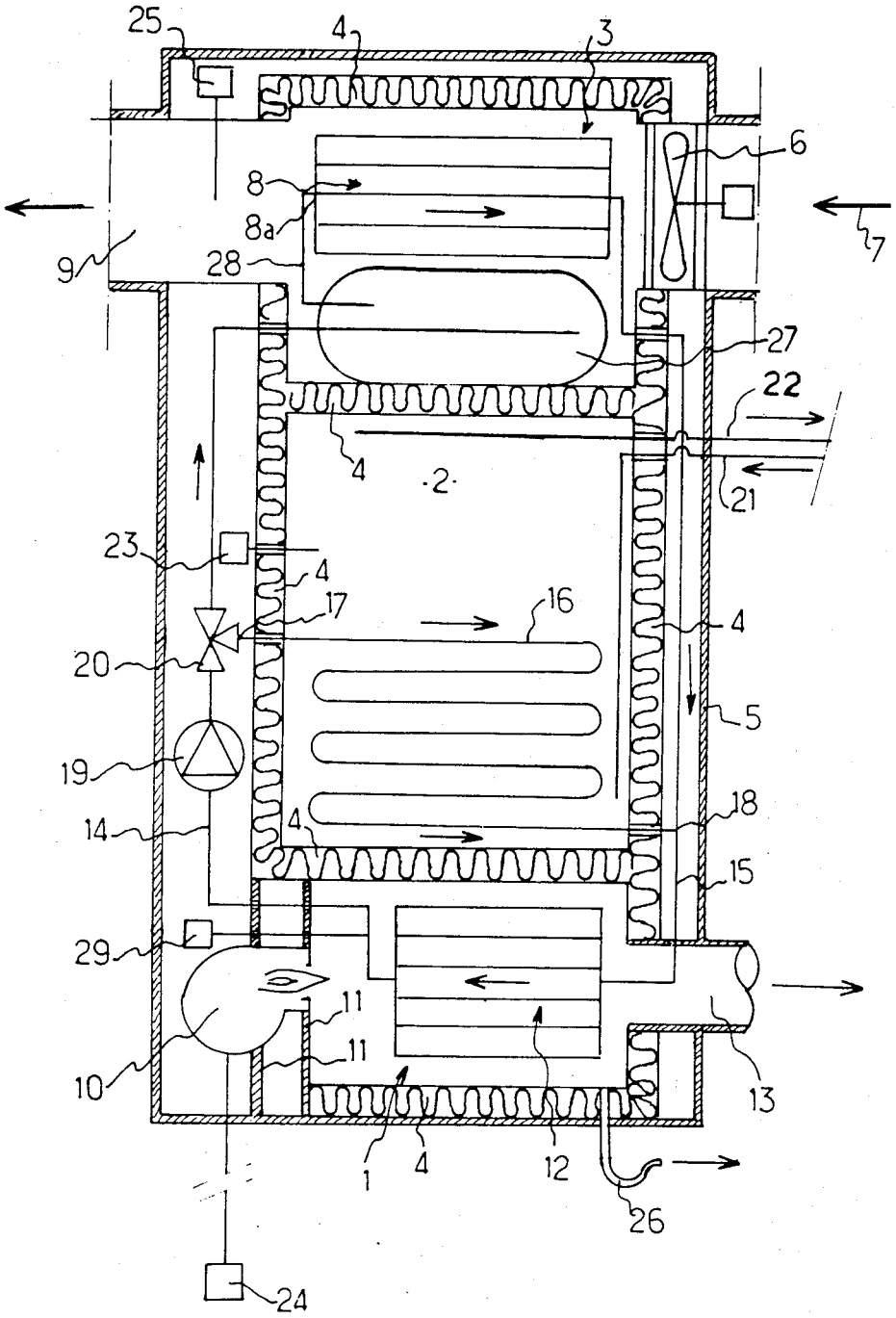
FIG. 2 is a diagrammatic elevational and vertical sectional view of another form of embodiment of the heating apparatus of the invention.

The modified form of embodiment of the apparatus shown in FIG. 2 differs from the one seen in FIG. 1 by the only fact that there is provided in the region of the hot-air generator 3 a buffer reservoir 27 communicating through a conduit 28 with the inlet 8*a* of the exchanger 8 and with the hot-water feed line 14. Of course the same reference numerals have been used to designate the elements indentical with those of FIG. 1. The use of the form of embodiment of FIG. 2 may be contemplated in case the capacity of the exchanger 8 seen in FIG. 1 is too important for a coil whose heating area is about 8.1 $m_2$. Consequently, in the case of FIG. 2, use is made here of an exchanger or coil 8 with a capacity of 10 liters and of a buffer reservoir such as 27 capable of containing 20 liters of water.

It will be noted, lastly, that both in the form of embodiments of FIG. 1 and that of FIG. 2, there may be provided a safety aquastat 29 mounted in the line 14 immediately downstream of the water-combustion products exchanger 12, the capacity of which may be for example of 20 liters in both cases.

There will now be described the operation and advantages of the apparatus of the invention in reference to the basic apparatus seen in FIG. 1.

As known per se, the burner 10, which is of a conventional design, operates in on-off mode and is controlled by the thermostat 24.

There will first be described the manner in which the heating of the hot water stored in the tank 2 takes place, such heating having priority over the heating of the air blown through the exchanger 8.

The aquastat 23 maintains the temperatures in the tank 2 between about 55° C. and 65° C. When the storage temperature reaches 55° C., the aquastat starts the burner 10 and the circulator 19, as also the supply of current through the winding of the electrovalve 20, thus causing the water heated by the exchanger 12 to be diverted to flow only towards the tube 16 immersed in the tank 2. When the temperature of the water in the tank reaches 65° C., the heating is interrupted.

As mentioned previously, there is a priority of the hot water for the sanitary fittings, so that there can be no heating of the air unless the temperature of the water stored is higher than 55°C. In this case, the electrovalve 20 ensures a supply of heated water through the exchanger 12 towards the water-air exchanger 8 only.

The heating is regulated by the thermostat 24 which controls the burner in on-off mode and by the airstat 25 located in the region 9 of the hot-air outlet.

More precisely, if the thermostatically controlled temperature of the room concerned is insufficient, the thermostat 24 starts the burner. When the said temperature is sufficient, the thermostat 24 puts the burner out of action, but the circulator 19 and the fan 6 continue to work, so that the hot-water loop having high inertia cools down very slowly, thus ensuring a decreasing blowing temperature. The airstat 25 only puts the fan 6 out of action if the blowing temperature reaches a lower critical threshold, for example about 25° C.

But it must be emphasized here that the present invention obviates the disadvantages inherent in the conventional hot-air generators provided with on-off control of the blown air flow.

Indeed, owing to the present invention, a control in the on-off mode is applied only to the burner and results in a modulating effect on the output temperature 9 of the blown hot air due to inertia, of the order of 50 liters, of the hot water loop. In other words, the temperature of the air blown is modulated according to needs, the blown air flow rate remaining constant and only being reduced to zero if the blowing temperature reaches a critical threshold.

It is therefore understood that the temperature of the air blown will fluctuate about a mean value which will be lower, the smaller the needs for the room to be heated.

In contrast to the conventional means of on-off control of the blown air flow, the modulated-temperature heating according to the principle of the present invention provides a very marked improvement in comfort as well as a better recovery of the solar and internal heat inputs, and a substantial economy in energy consumption. Lastly, it will be noted that the heating apparatus of the invnetion can advantageously be associated with passive solar designs, such as for example ventilated glass-houses.

Of course, the invention is by no means limited to the forms of embodiment described and illustrated.

On the contrary, it includes all technical equivalents to the means described as well as their combinations if the latter are carried out according to its gist.

What is claimed is:

1. An apparatus for heating a space comprising in combination:

a hot air generator comprising at least one water-air exchanger with high thermal inertia and at least one fan associated with said exchanger for blowing air therethrough into the space to be heated;

a hot water generator comprising a burner and a second exchanger for heat exchange between the water and the combustion products of said burner;

a feed water line and a return water line respectively connecting said second exchanger to said water-air exchanger;

a tank for sanitary hot water;

a circuit extending through said tank for reheating the hot water stored therein, siad circuit communicating, on the one hand, with said feed water line, and, on the other hand, with said return water line; and an electrovalve provided on said feed line to allow communication of the same with either said reheating circuit or with said water-air exchanger;

wherein said hot air generator, said storage tank, and said hot water generator are arranged in three heat-insulated tiers combined into a single unit.

2. An apparatus according to claim 1, further comprising a buffer reservoir associated with said hot air generator and communicating, on the one hand, with said feed line, and, on the other hand, with said water-air exchanger.

3. An apparatus according to claim 1, further comprising an aquastat associated with said water storage tank and connected to said burner so as to ensure reheating of the hot water in said tank in priority to the heating of the water fed to said water-air exchanger.

* * * * *